United States Patent [19]

Kronich et al.

[11] Patent Number: 5,044,294

[45] Date of Patent: Sep. 3, 1991

[54] MAST TRACK SYSTEM FOR SAILING VESSEL

[75] Inventors: Christine G. Kronich, Pewaukee; Gregory W. Hartlmeier, Milwaukee; Peter O. Harken, Pewaukee, all of Wis.

[73] Assignee: Harken, Inc., Pewaukee, Wis.

[21] Appl. No.: 579,066

[22] Filed: Sep. 5, 1990

[51] Int. Cl.[5] ..... B63H 9/04

[52] U.S. Cl. ..... 114/112; 114/90; 114/39.1

[58] Field of Search ..... 114/39.1, 102, 103–112, 114/89, 90, 97

[56] References Cited

U.S. PATENT DOCUMENTS

| | | | |
|---|---|---|---|
| 1,829,413 | 10/1931 | Kozlay | 114/112 |
| 3,092,064 | 6/1963 | Benedict | 114/112 |
| 4,072,121 | 2/1978 | Anderson et al. | 114/90 |
| 4,211,179 | 7/1980 | Saunders | 114/90 |
| 4,452,164 | 6/1984 | Dejager | 114/112 |
| 4,526,122 | 7/1985 | Kluckhuhn | 114/107 X |

FOREIGN PATENT DOCUMENTS

| | | | |
|---|---|---|---|
| 978910 | 1/1965 | United Kingdom | 114/112 |

*Primary Examiner*—Ed Swinehart
*Attorney, Agent, or Firm*—Juettner Pyle & Lloyd

[57] ABSTRACT

A traveler track is provided for supporting the sail of a sailboat, and is itself supported by a plurality of lugs which are received in a rearwardly facing groove in the mast, which would normally receive the boltrope of the sail. The lugs are slidable in the groove during installation, and are loosely secured by threaded fasteners at spaced locations to the track sections. Successive sections are installed by pushing up previous sections loosely installed in the groove. After all sections have been installed, the threaded fasteners are tightened to place tension between the track and the portion of the lug engaged in the groove.

8 Claims, 3 Drawing Sheets

16
18
20
12
22
18
20
14
10

MAST TRACK SYSTEM FOR SAILING VESSEL

BACKGROUND OF THE INVENTION

This invention relates to sailing vessels and more particularly to a track system for a mast and a method of mounting a track on the mast of a sailing vessel.

Masts for sail vessels such as sailboats have a rearwardly facing slot or groove for supporting a luff or leading edge of a mainsail. For example, the luff of the sail may be attached to a bolt rope, and a circular groove having a restricted opening may be provided in the mast. The boltrope is introduced at an enlarged opening in the groove near the bottom of the mast, and the sail may be raised and lowered using a halyard attached to the head of the sail. In other arrangements, the luff may be secured to a plurality of spaced lugs which are slidably received in the mast groove, for example, wherein the groove has a T-shaped cross section and receives a T-shape lug.

In recent times, especially with the advent of full batten mainsails, a rearwardly facing external track has been mounted on the mast. The track is designed to slidably carry a number of cars. The forward ends of individual battens, which extend entirely between the luff and leech of the sail, are connected to individual cars. Since the battens are usually in compression, the track and traveler system facilitates the raising and lowering of the sail. U.S. Pat. No. 4,823,720 illustrates the use of a particular swivel joint between a mainsail batten and the mast. Mast track systems are generally shown on pages 98 and 99 of the 1990 Harken Yacht Equipment catalog, Harken, Inc., 1251 East Wisconsin Avenue, Pewaukee, Wis. 53072.

Mounting of a track on the mast is a time consuming and laborious process, usually requiring skilled labor. Individual track sections are supplied with a plurality of longitudinally spaced screw holes. It is necessary to drill holes in the mast, tap the holes and secure the section to the mast and in longitudinal alignment with each other using screws.

SUMMARY OF THE INVENTION

An object of the present invention is to provide a simple and convenient method and arrangement for mounting a traveler track on a mast of a sailing vessel.

Another object of the invention is to provide a track mounting system which utilizes the existing groove in the mast for installation and securement and eliminates the necessity for drilling and tapping threaded openings in the mast.

In accordance with the present invention, the track is supported on the mast by a plurality of lugs which are received or contained in the groove of the mast, extend through the restricted opening of the groove, and terminate at an enlarged portion having a threaded opening. The track is provided with a longitudinal channel which fits over and receives the terminus of the lug.

The lugs are slidable in the groove during installation. The lugs are inserted into the groove and are loosely secured by threaded fasteners at spaced locations to the track sections. Successive sections are installed by pushing up previous sections loosely installed in the groove. After all sections have been installed, the threaded fasteners are tightened to place tension between the track and the portion of the lug engaged in the he groove. The track may be installed with the mast lowered, or the sections may be installed on an upright mast and secured with the aid of a bosun's chair.

THE DRAWINGS

DESCRIPTION OF THE PREFERRED EMBODIMENT

Figure 1:
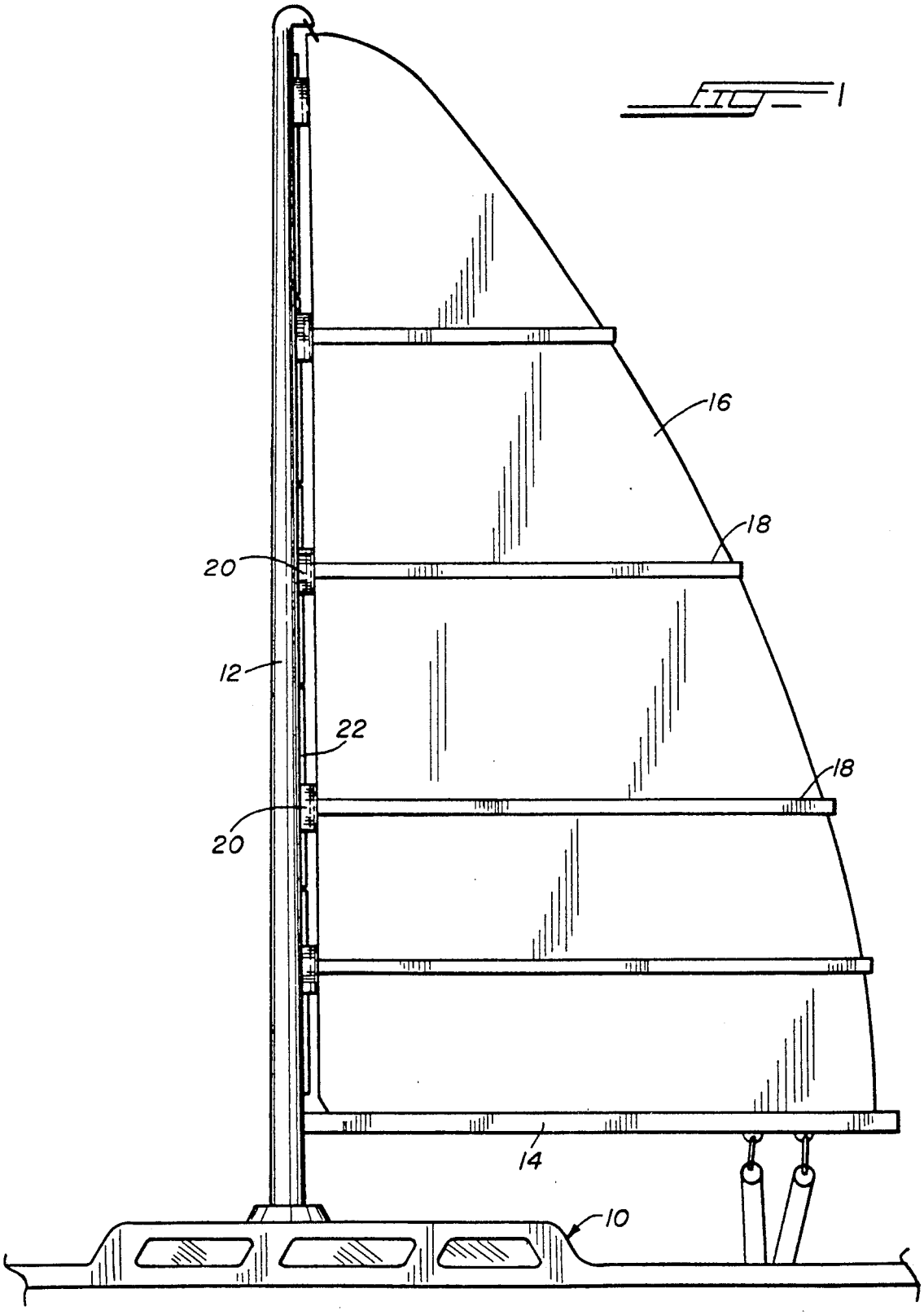
FIG. 1 is a side view of a portion of a sailboat having a mast and associated full batten mainsail.

FIG. 1 generally shows a sailboat 10 having an upright mast 12 and a horizontal boom 14 arranged and supported in a conventional manner. The mast 12 supports a mainsail 16 along the luff thereof, with a plurality of spaced, horizontally disposed, full length battens 18 extending from luff to leech in the sail. The forward ends of the battens 18 are pivotally connected to individual cars 20 slidably mounted on a track 22 affixed along and coextensive with the aft longitudinal portion of the boom. The track 22 as shown in FIG. 2, comprises a plurality of elongated sections **22*a* and 22*b* butted together endwise and secured to the mast by a plurality of threaded fasteners extending through spaced openings 24** in the track and into the mast structure.

One version of the mounting system is illustrated in FIGS. 4 through 7. As shown, the mast 40 has a rearwardly facing groove 42 which is rounded or substantially circular in cross section. The groove 42 extends coextensively in a straight line along the length of the mast and communicates with a exteriorly extending slot 44 having a width smaller than the width or diameter of the groove.

Figure 4:
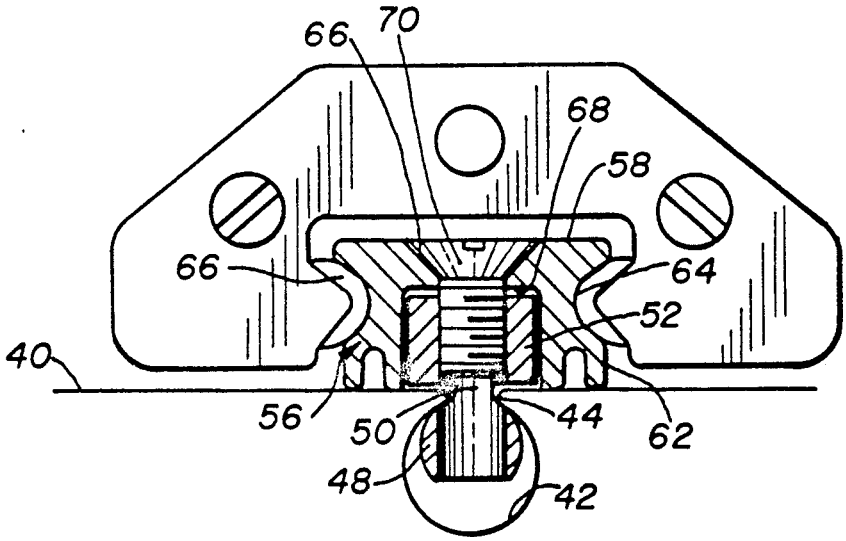

In normal use, the mast shown in FIG. 4 is used with a sail attached to a boltrope or other rounded form, and the boltrope is inserted into the groove 42 near the bottom of the mast. The sail is raised and lowered in a conventional manner and is supported along the entire luff by the engagement of the boltrope in the confined groove.

Figure 2:
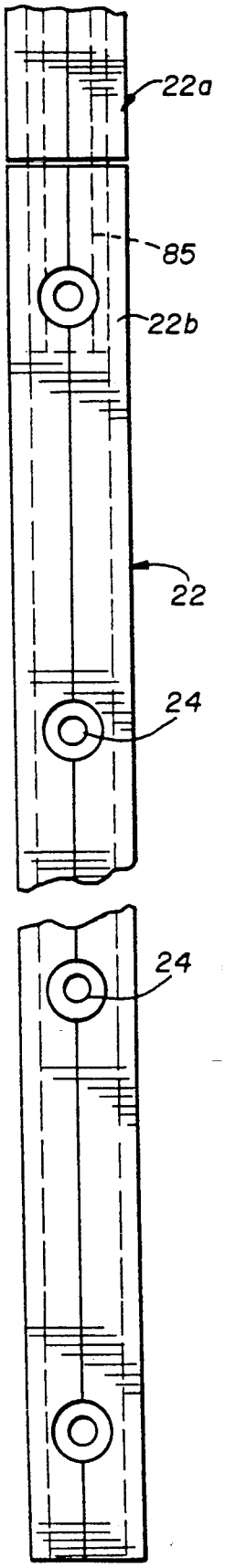
FIG. 2 is a plan view of the track used in connection with the present invention.
Figure 5:
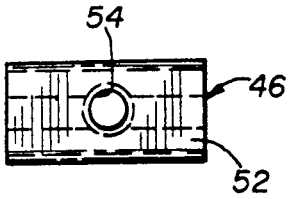
FIGS. 5, 6 and 7 are top, side and end views of the lug used in the embodiment shown in FIG. 4.
Figure 6:
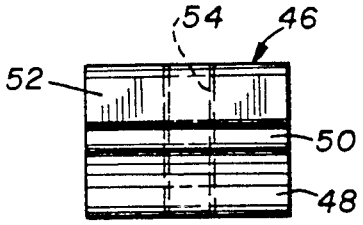
Figure 7:
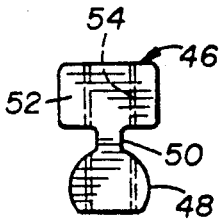

In accordance with the present invention, the mast groove 42 and restricted slot 44 are employed as a foundation to mount and secure the track sections shown in FIG. 2.

As shown in FIGS. 4–7, a plurality of lugs 46 are provided. Each lug 46 comprises a first enlarged portion 48 having a cross section of similar dimension to the groove 42 and adapted to fit into and slide in the he groove. A web 50 is connected the first portion and is thinner than, and extends through the slot 44 to the exterior surface of the mast. The other end of the web 50 is connected to a second enlarged portion 52 having a horizontally outward facing threaded opening 54.

The track 56 has a conventional outer profile comprising a top wall 58 having a series of spaced openings such as 60 therein, and a pair of side walls 62 having rounded grooves 64 therein for the mounting of a conventional traveler car 64 on bearings 66, with the car being freely slidable along the length of the track. While the traveler car as shown uses a plurality of recirculating ball bearings, other types of conventional cars may be employed.

In addition, the track 56 is provided with a longitudinal channel 68 in the bottom. The width of the groove is sized to fit over and entirely receive the protruding portion 52 of the lug 46, with a space between the top of the lug and the bottom of the groove.

As shown, a threaded fastener 70 is provided through the opening 60 and is in threaded engagement with the threaded opening 54 of the lug. As indicated above, sufficient space or freeplay is provided in the assembly so that tension imposed by the fastener causes the lug to be locked against the walls of the groove 42.

Figure 3:
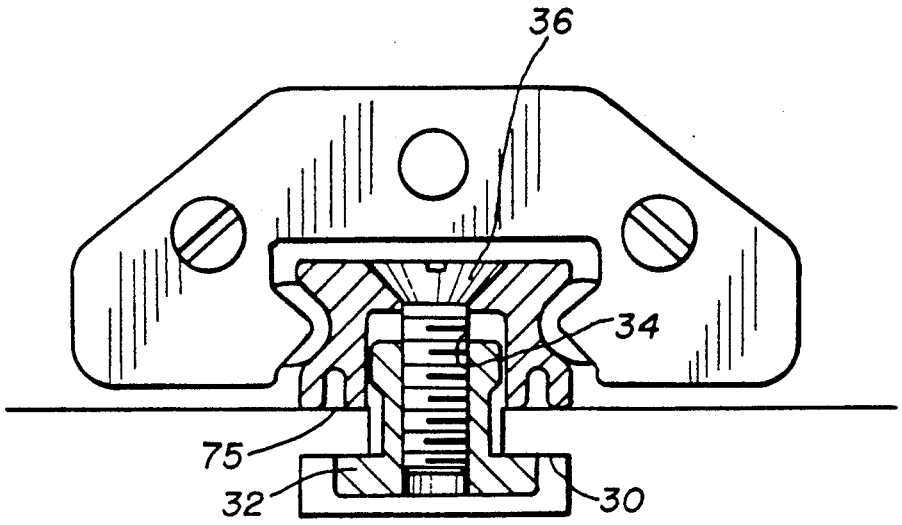
FIGS. 3 and 4 are transverse sectional views of two different versions of the mounting system of the present invention, corresponding to two different types of mast grooves.

FIG. 3 illustrates on a similar arrangement with the exception of the shape of the groove and the lug. In some cases, the mast has a T-shaped slot 30 to which the sail is normally attached by outwardly extending lugs. In such a case, a T-shaped lug 32 may be provided, with the central leg extending through the narrower opening and having a threaded opening 34 for receiving a fastener 36 as aforesaid. It will be understood that it is possible to adapt the mounting system of the present invention to grooves of various configurations.

Assembly of the track onto the mast is greatly simplified in comparison with prior practices. A section of track and associated lugs may be loosely assembled with fasteners. For example, the track section can be placed against one or more lugs and loosely secured. If desired, lugs may be singly introduced an pushed into register with the track openings using a thin piece of rigid plastic or metal inserted between the track and the mast, followed by loose assembly of a screw or bolt.

After loose assembly of one track section on the mast, it may be pushed up the mast with a second track section to enable the second section to be installed. This procedure may be repeated by pushing up the previous sections until all sections are loosely secured. Thereafter, final alignment and securement of the track sections in an abolting relation can be made using a bonsun's chair attached to a halyard extending from the top of the mast.

In addition to ease of assembly and installation, the system of the present invention offers additional benefits. The bottom channel 68 in the track reduces the weight of the track and therefore reduces the objectionable weight that would other wise be carried aloft on the mast. Additional longitudinal grooves 75 may be provided between the side walls 62 and central groove 42 of the track to achieve additional savings in weight.

To provide additional support for the final assembly, FIG. 2 illustrates the use of an insert or splice 85 which is inserted into the channel 68 of adjacent track sections. The insert 85 may have openings corresponding to the openings at the ends of adjacent track sections, with the insert spanning the adjacent sections and being secured to the track and lugs.

We claim:

1. A mast track system for a sailing vessel wherein the vessel comprises an upright mast having a rearwardly facing groove with a restricted opening for normally supporting the luff of a sail, said system comprising a track extending along said mast over said groove, a plurality of lugs in said groove, means for securing said track to said lugs through said restricted opening to secure said track to said mast, and a plurality of traveler cars slidably mounted on said track.

2. The mast track system of claim 1 wherein said lugs comprise a first enlarged portion slidably received in said groove, a second thinner portion extending through said restricted opening, and a third enlarged portion outside of the groove.

3. The mast track system of claim 2 wherein the third enlarged portion comprises a threaded opening.

4. The mast track system of claim 1 wherein said track has a longitudinal channel receiving the third enlarged portion of said lugs.

5. The mast track system of claim 2 wherein said groove is rounded in section and said first portion is rounded to fit into said groove.

6. The mast track system of claim 2 wherein said groove and restricted opening are T-shaped in cross section and wherein said first and second portions are T-shaped.

7. The mast track system of claim 1 wherein the means for securing said track to said lugs comprises an outwardly facing threaded opening in each lug, and threaded fastener means for securing said track to said lug.

8. A method for mounting a track to a mast of a sailing vessel wherein the mast has a rearwardly facing groove with a restricted opening, said method comprising the steps of providing said track in a plurality of sections, slidably inserting a plurality of lugs into said groove in longitudinally spaced locations, loosely securing a first section of track to said lugs, then loosely securing successive sections by pushing the previous sections along the groove, and then securing said track sections to said lugs with said sections in abutting relationship.

* * * * *